US007866961B2

(12) United States Patent
Masuda

(10) Patent No.: US 7,866,961 B2
(45) Date of Patent: Jan. 11, 2011

(54) COMPRESSOR WITH DISCHARGE VALVE ARRANGEMENT

(75) Inventor: Masanori Masuda, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 30 days.

(21) Appl. No.: 11/792,320

(22) PCT Filed: Dec. 5, 2005

(86) PCT No.: PCT/JP2005/022279

§ 371 (c)(1),
(2), (4) Date: Jun. 5, 2007

(87) PCT Pub. No.: WO2006/062051

PCT Pub. Date: Jun. 15, 2006

(65) Prior Publication Data

US 2008/0113538 A1 May 15, 2008

(30) Foreign Application Priority Data

Dec. 6, 2004 (JP) ..... 2004-352612

(51) Int. Cl.
*F04B 39/10* (2006.01)
*F04B 53/10* (2006.01)
*F16K 15/16* (2006.01)

(52) U.S. Cl. ..... 417/569; 137/856

(58) Field of Classification Search ..... 417/469, 417/269, 559, 569, 410.3; 418/181, 243; 137/855, 856, 857, 858
See application file for complete search history.

(56) References Cited

U.S. PATENT DOCUMENTS 3,998,571 A * 12/1976 Falke ..... 417/569
4,401,068 A * 8/1983 Bristol ..... 123/198 F
4,605,362 A * 8/1986 Sturgeon et al. ..... 418/63
4,730,996 A * 3/1988 Akatsuchi et al. ..... 418/15
4,784,581 A * 11/1988 Fritchman ..... 417/312
4,955,797 A * 9/1990 Cowen ..... 418/15
5,203,679 A * 4/1993 Yun et al. ..... 417/312
5,203,686 A * 4/1993 Scheldorf et al. ..... 418/63
5,213,125 A * 5/1993 Leu ..... 137/15.18
5,385,451 A * 1/1995 Fujii et al. ..... 417/269

(Continued)

FOREIGN PATENT DOCUMENTS

JP 57-172970 U 10/1982

(Continued)

OTHER PUBLICATIONS

Machine Translation of JP2001280254A.*

(Continued)

*Primary Examiner*—Devon C Kramer
*Assistant Examiner*—Nathan Zollinger
(74) *Attorney, Agent, or Firm*—Global IP Counselors

(57) ABSTRACT

A fixing bolt is inserted into a through hole of an end-face member and screwed with a screw hole of a valve holding member, by which a discharge valve is sandwiched by the end-face member and the valve holding member. Thus, since a thickness of the end-face member can be provided thinner, a capacity of a discharge hole of the end-face member is made smaller so that degradation of operating efficiency as well as increase of operating noise are prevented.

15 Claims, 7 Drawing Sheets

U.S. PATENT DOCUMENTS

| | | | | |
|---|---|---|---|---|
| 5,554,016 | A | 9/1996 | Sasano et al. | |
| 5,647,395 | A * | 7/1997 | Hashimoto et al. | 137/517 |
| 5,672,053 | A * | 9/1997 | Sabha | 417/569 |
| 5,674,061 | A * | 10/1997 | Motegi et al. | 418/55.1 |
| 6,176,687 | B1 * | 1/2001 | Kim et al. | 417/312 |
| 6,592,346 | B2 * | 7/2003 | Bushnell | 418/63 |
| 6,679,688 | B2 * | 1/2004 | Sato et al. | 417/559 |
| 7,201,189 | B2 * | 4/2007 | Inui et al. | 137/855 |
| 2002/0119059 | A1 * | 8/2002 | Sato et al. | 417/571 |
| 2003/0086796 | A1 * | 5/2003 | Park et al. | 417/360 |

FOREIGN PATENT DOCUMENTS

| | | | |
|---|---|---|---|
| JP | 61-5373 | U | 1/1986 |
| JP | 62-210283 | A | 9/1987 |
| JP | 02176197 | A * | 7/1990 |
| JP | 05-215088 | A | 8/1993 |
| JP | 06-79695 | U | 11/1994 |
| JP | 07-145781 | A | 6/1995 |
| JP | 07247974 | A * | 9/1995 |
| JP | 10-176670 | A | 6/1998 |
| JP | 10176670 | A * | 6/1998 |
| JP | 2000-087857 | A | 3/2000 |
| JP | 2000320479 | A * | 11/2000 |
| JP | 2001-182650 | A | 7/2001 |
| JP | 2001-280254 | A | 10/2001 |
| JP | 2001280254 | A * | 10/2001 |
| JP | 2003-254243 | A | 9/2003 |

OTHER PUBLICATIONS

Human Translation of JP10176670A.*

* cited by examiner

COMPRESSOR WITH DISCHARGE VALVE ARRANGEMENT

CROSS-REFERENCE TO RELATED APPLICATIONS

This U.S. National stage application claims priority under 35 U.S.C. §119(a) to Japanese Patent Application No. 2004-352612, filed in Japan on Dec. 6, 2004, the entire contents of which are hereby incorporated herein by reference.

TECHNICAL FIELD

The present invention relates to a compressor such as a rotary compressor to be used in air conditioners or the like.

BACKGROUND ART

A conventional compressor, as shown in FIG. 10, has an upper frame 100 of a cylinder having a discharge hole 100*a* opening within the cylinder, a discharge valve 101 for opening and closing the discharge hole 100*a* of the upper frame 100, a valve holding member 102 for sandwiching the discharge valve 101 in cooperation with the upper frame 100, and a fixing bolt 103.

The valve holding member 102 has a through hole 102*a*, and the upper frame 100 has a screw hole 100*b*.

Then, the fixing bolt 103 is inserted into the through hole 102*a* of the valve holding member 102 and is screwed with the screw hole 100*b* of the upper frame 100. As a result, the discharge valve 101 is sandwiched and held between the upper frame 100 and the valve holding member 102 (see JP 61-5373 U).

However, with the conventional compressor as shown above, in which the upper frame 100 has the screw hole 100*b*, there has been a need for increasing the thickness of the upper frame 100 to ensure an effective thread length. This would result in increased axial (thicknesswise) sizes of the screw hole 100*b* of the upper frame 100, which in turn would result in increased capacities (hereinafter, referred to as top clearance) of the discharge hole 100*a* of the upper frame 100.

Thus, such a large top clearance would lead to an increased quantity of compressed gas remaining in the discharge hole 100*a* at an end of compression, which would incur efficiency degradation of the compressor as well as increase of operating noise due to re-expansion of the compressed gas derived from within the discharge hole 100*a*.

More specifically, the capacity efficiency would lower with a low-speed operation of the compressor, while the motive power would increase with a high-speed operation of the compressor. Besides, a pulsating pressure caused by the re-expansion of compressed gas would incur increase of the operating noise.

SUMMARY OF THE INVENTION

Accordingly, an object of the present invention is to provide a compressor which is improved in performance with the discharge hole decreased in capacity.

In order to achieve the above object, according to the present invention, there is provided a compressor comprising:

a cylinder body which forms a cylinder chamber;

an end-face member which is mounted on an end face of the cylinder body and which has a discharge hole communicating with the cylinder chamber and a through hole;

a discharge valve for opening and closing the discharge hole of the end-face member;

a valve holding member which sandwiches the discharge valve in cooperation with the end-face member and which has a screw hole; and a fixing bolt having a head portion, wherein the head portion of the fixing bolt is placed on one side of the end-face member on which the cylinder body is provided, and the fixing bolt is inserted into the through hole of the end-face member so as to be screwed with the screw hole of the valve holding member, in which state the discharge valve is sandwiched by the end-face member and the valve holding member.

In the compressor of this invention, the fixing bolt is inserted into the through hole of the end-face member and screwed with the screw hole of the valve holding member, in which state the discharge valve is sandwiched by the end-face member and the valve holding member. Therefore, there is no need for threading the through hole of the end-face member, so that a thickness of the end-face member around the through hole can be made thinner. That is, the axial (thicknesswise) size of the discharge hole of the end-face member can be set to a small one.

Thus, the capacity (space) of the discharge hole of the end-face member can be made smaller, so that compressed gas remaining within the discharge hole at an end of compression can be made smaller in quantity. Accordingly, degradation of operating efficiency as well as increase of operating noise caused by re-expansion of the compressed gas derived from within the discharge hole can be prevented. More specifically, the capacity efficiency can be enhanced with a low-speed operation of the compressor, while the motive power can be decreased with a high-speed operation of the compressor. Besides, a pulsating pressure caused by the re-expansion of the compressed gas can be decreased, so that the operating noise can be decreased.

Also, the fixing bolt and the screw hole of the valve holding member are coupled to each other, of course, by a screw. Therefore, in comparison with the case where the valve holding member and the end-face member are fixed by a rivet, it becomes possible to retighten the fixing bolt, as well as to correct alignment between the discharge valve and the discharge hole. Further, in comparison with the case where the valve holding member and the end-face member are fixed by screw and nut, the parts count is decreased so that the assembly working efficiency is improved.

In an embodiment, the cylinder body has, in an end face of the cylinder body, a recessed portion for housing therein the head portion of the fixing bolt.

In the compressor of this embodiment, since the cylinder body has, in an end face of the cylinder body, a recessed portion for housing therein the head portion of the fixing bolt, the head portion of the fixing bolt can be hidden in the recessed portion of the end face of the cylinder body. Thus, since the fixing bolt can be placed so as to avoid the cylinder chamber (compression chamber), the through hole of the end-face member, into which the fixing bolt is to be inserted, does not serve as a bypass passage for the cylinder chamber, thus keeping from any degradation of compression performance.

In an embodiment, the screw hole of the valve holding member is finished by burring process.

In the compressor of this embodiment, since the screw hole of the valve holding member is finished by burring process, an effective thread length can be ensured without increasing the thickness of the valve holding member. Also, a periphery of the screw hole on one side on which the fixing bolt is to be inserted through can be automatically chamfered so as to be rounded, providing a guide for insertion of the fixing bolt to facilitate the assembly.

In an embodiment, the valve holding member is formed of a punched material of steel.

In the compressor of this embodiment, since the valve holding member is formed of a punched material of steel, the number of stage changing steps for the burring process of the screw hole can be reduced. Thus, the valve holding member can be manufactured with low cost.

In an embodiment, the end-face member is formed of a casting or sintered material.

In the compressor of this embodiment, since the end-face member is formed of a casting or sintered material, the end-face member can be manufactured with low cost.

In an embodiment, the discharge valve has a projecting portion which enters into the discharge hole of the end-face member.

In the compressor of this embodiment, since the discharge valve has the projecting portion that enters into the discharge hole of the end-face member, the capacity of the discharge hole of the end-face member can be made further smaller by the entry of the projecting portion of the discharge valve into the discharge hole of the end-face member, so that the compressed gas remaining within the discharge hole at an end of compression can be made further smaller in quantity. Thus, degradation of the operating efficiency as well as increase of the operating noise can be further suppressed.

By the entry of the projecting portion of the discharge valve into the discharge hole of the end-face member, sealability of the discharge valve for the discharge hole can be ensured. Also, when the discharge valve is assembled to the end-face member, performing the positioning with the projecting portion entered into the discharge hole facilitates the assembling of the discharge valve to the end-face member.

In an embodiment, the projecting portion of the discharge valve is formed into such a tapered configuration that the projecting portion becomes thinner at its tip, and the discharge hole of the end-face member is formed into a tapered configuration corresponding to the configuration of the projecting portion.

In the compressor of this embodiment, since the projecting portion and the discharge hole of the end-face member are formed into tapered configurations, the projecting portion can be fitted into the discharge hole in a generally coincident state, so that sealability of the discharge valve for the discharge hole can be further improved.

In an embodiment, the valve holding member has:

a platy body portion having a hole portion; and an annular protruding portion provided around the hole portion on one surface of the body portion opposite to a surface on which the discharge valve is provided, wherein an inner circumferential surface of the hole portion of the body portion is formed into a cylindrical surface and a tapered surface in an order from the one surface side toward the other side of the body portion, an inner circumferential surface of the annular protruding portion is formed into a cylindrical surface which is equal in diameter to the cylindrical surface of the body portion and which concentrically adjoins the cylindrical surface of the body portion, and the cylindrical surface of the body portion and the cylindrical surface of the annular protruding portion cooperatively form the screw hole.

In the compressor of this embodiment, since the inner circumferential surface of the hole portion of the body portion in the valve holding member is formed into the cylindrical surface and the tapered surface, the fixing bolt, when inserted into the hole portion of the valve holding member, is aligned by the tapered surface of the hole portion, so that the fixing bolt can be led to the screw hole with reliability.

Also, the portion of the body portion where the tapered surface is formed comes to have elasticity, so that the screw hole becomes reducible or expandable in diameter. Accordingly, when the fixing bolt is screwed with the screw hole, any initial loosening of the fixing bolt due to the screw hole can be prevented.

Further, since the cylindrical surface of the body portion and the cylindrical surface of the annular protruding portion cooperatively form the screw hole, the cylindrical surface of the annular protruding portion allows the screw hole to be elongated in thread length.

In an embodiment, the screw hole has a thread length equal to or more than a thickness of the body portion.

In the compressor of this embodiment, since the screw hole has the thread length equal to or more than a thickness of the body portion, the thread length of the screw hole can be ensured even with the thickness of the body portion decreased, so that the fixing bolt can be tightened to the screw hole with reliability.

In an embodiment, a depressed portion for housing therein the discharge valve and the valve holding member is provided in an end face of the end-face member, the depressed portion has one side face and the other side face which are generally opposed to each other, the one side face and the other side face are located on both sides of respective sites around the fixing bolt in the discharge valve and the valve holding member so as to allow a positioning of those sites, respectively, the one side face is placed on one side on which when the fixing bolt is rotated in a direction in which the fixing bolt is tightened to the screw hole of the valve holding member from the cylinder body side of the end-face member, the valve holding member integrally rotates along with the fixing bolt so that a portion of the valve holding member on one side closer to the discharge hole than an axis of the fixing bolt makes contact with the one side face, and the other side face is placed on one side on which when the fixing bolt is rotated in a direction in which the fixing bolt is tightened to the screw hole of the valve holding member from the cylinder body side of the end-face member, the valve holding member integrally rotates along with the fixing bolt so that a portion of the valve holding member on one side closer to the discharge hole than the axis of the fixing bolt goes away from the other side face.

In the compressor of this embodiment, since the depressed portion has the one side face and the other side face, the discharge valve and the valve holding member, in the tightening of the fixing bolt to the screw hole, are securely blocked by the one side face of the depressed portion even if those are integrally rotated by following the rotation of the fixing bolt. Further, the other side face together with the one side face can easily lead the discharge valve and the valve holding member toward the through hole side.

In an embodiment, a length of the one side face from the through hole toward the discharge hole is longer than a length of the other side face from the through hole toward the discharge hole.

In the compressor of this embodiment, since the length of the one side face from the through hole toward the discharge hole is longer than the length of the other side face from the through hole toward the discharge hole, the discharge valve and the valve holding member, in the tightening of the fixing bolt to the screw hole, are securely blocked by the one side face of the depressed portion even if those are integrally rotated by following the rotation of the fixing bolt. Further, since the other side face is shorter than the one side face, a space of the depressed portion on the other side face side can be made larger so that reduction of the discharge space can be prevented. Accordingly, rotational position accuracy of the discharge valve and the valve holding member in their assembly can be improved by the one side face side of the depressed portion, while increase in discharge pressure loss can be avoided by the other side face side of the depressed portion.

In an embodiment, the discharge valve has a cover portion which goes into or out of contact with the discharge hole, and when the fixing bolt is rotated in the direction of being tightened from the cylinder body side of the end-face member, the discharge valve integrally rotates along with the valve holding member, and when a portion of the discharge valve closer to the discharge hole than the axis of the fixing bolt comes into contact with the one side face of the depressed portion, a center of the cover portion of the discharge valve and a center of the discharge hole become generally coincident with each other.

In the compressor of this embodiment, when the discharge valve comes into contact with the one side face of the depressed portion, the center of the cover portion of the discharge valve and the center of the discharge hole become generally coincident with each other. Therefore, when the fixing bolt is tightened to the screw hole, the discharge valve integrally rotates along with the valve holding member by following the rotation of the fixing bolt, thus making contact with the one side face of the depressed portion. Accordingly, tightening the fixing bolt allows the center of the cover portion of the discharge valve and the center of the discharge hole to automatically become generally coincident with each other, so that the positional accuracy of the discharge valve and the discharge hole can be further improved.

In an embodiment, the recessed portion forms a Helmholtz type resonance chamber, and a connecting passage for connecting the resonance chamber and the cylinder chamber to each other is provided in the cylinder body.

In the compressor of this embodiment, since the recessed portion forms a Helmholtz type resonance chamber, waves of pulsating noise of the refrigerant gas that occurs upon compression in the cylinder chamber interfere with interferential waves derived from the resonance chamber so as to damp to a large extent. Therefore, pulsating noise decreases, so that a reduction of noise can be achieved. Thus, the recessed portion can be used both as a space for housing the bolt head portion therein and as a resonance chamber.

DETAILED DESCRIPTION OF THE INVENTION

Hereinbelow, the present invention will be described in detail by way of embodiments thereof illustrated in the accompanying drawings.

First Embodiment

Figure 1:
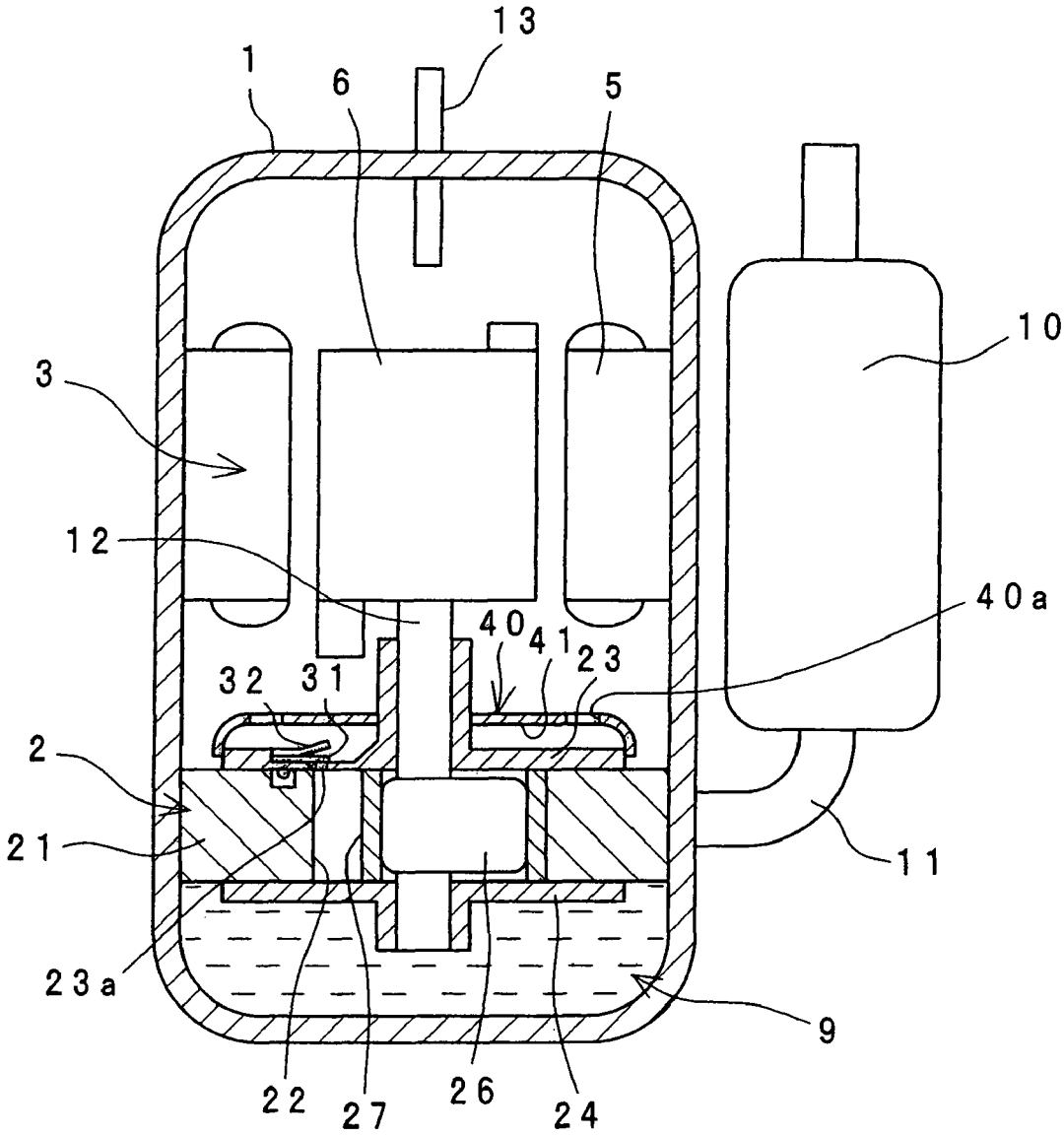
FIG. 1 is a sectional view showing a first embodiment of a compressor according to the present invention.

FIG. 1 shows a sectional view of a first embodiment of the compressor of the invention. The compressor of the invention is a rotary compressor of the so-called high-pressure dome type, in which a compression section 2 is placed below and a motor 3 is placed above within a casing 1. The compression section 2 is driven via a drive shaft 12 by a rotor 6 of the motor 3.

The compression section 2 sucks in a wet gas (refrigerant) through a suction pipe 11 from an accumulator 10. The wet gas can be obtained by controlling a condenser, an expansion mechanism and an evaporator (not shown) which constitute an air conditioner as an example of a refrigeration system together with this compressor.

The compressor discharges a compressed high-temperature, high-pressure discharge gas from the compression section 2 to fill the inside of the casing 1 therewith and, moreover, to cool the motor 3 through a clearance between a stator 5 and the rotor 6 of the motor 3, and thereafter discharges outside through a discharge pipe 13. Below a high-pressure region within the casing 1 is accumulated lubricating oil 9.

Figure 2:
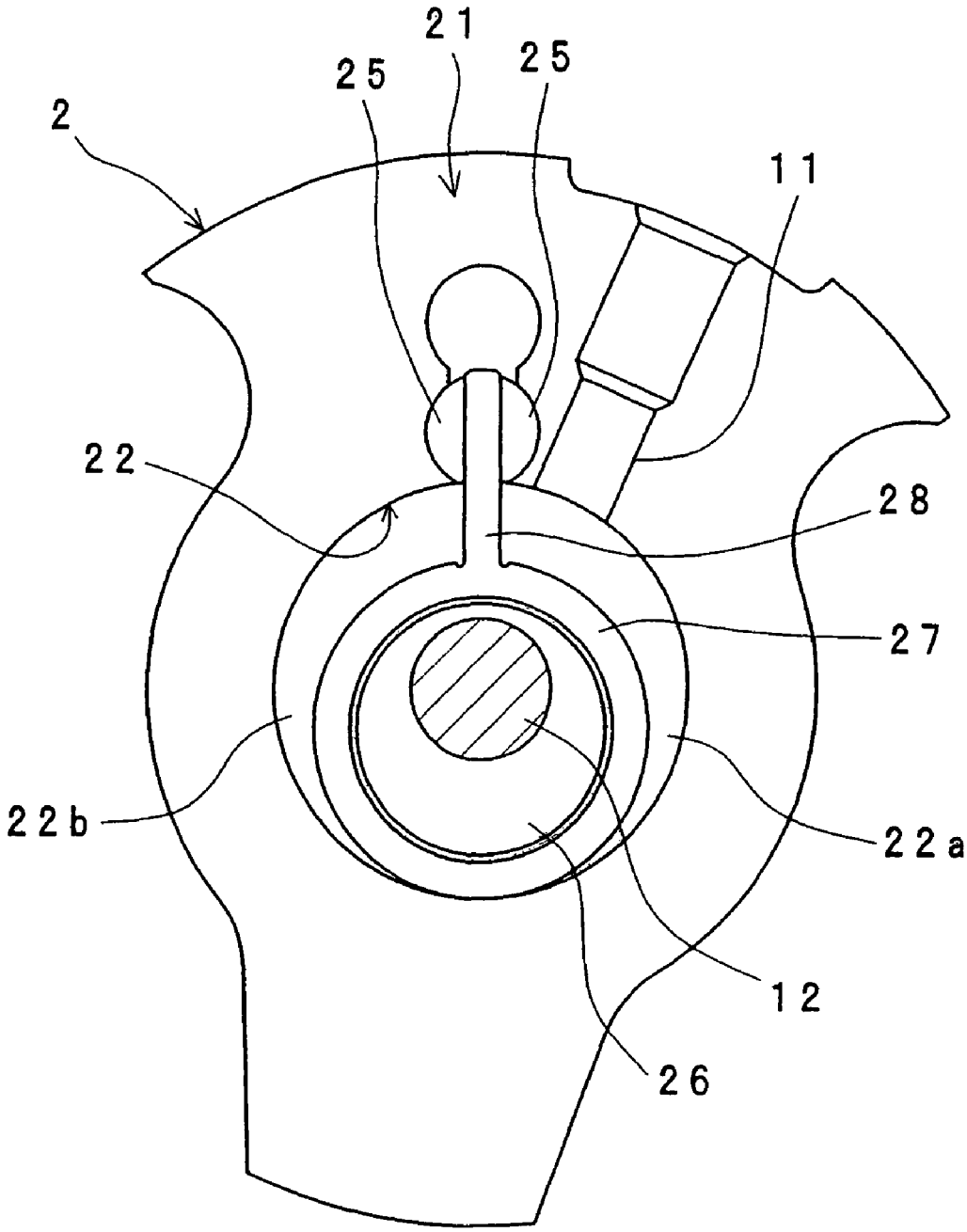
FIG. 2 is a plan view of the compressor.

As shown in FIGS. 1 and 2, the compression section 2 includes a cylinder body 21 forming a cylinder chamber 22, and an upper end-face member 23 and a lower end-face member 24 which are mounted at upper-and-lower end faces of the cylinder body 21 to cover the cylinder chamber 22.

The drive shaft 12 extends through the upper end-face member 23 and the lower end-face member 24, running to the inside of the cylinder chamber 22.

A roller 27 fitted into a crankpin 26 provided on the drive shaft 12 is revolvably placed in the cylinder chamber 22, so that the compression action can be achieved by revolution of the roller 27.

The interior of the cylinder chamber 22 is partitioned by a blade 28 provided integrally with the roller 27. That is, as shown in FIG. 2, in a chamber on the right side of the blade 28, the suction pipe 11 opens to an inner surface of the cylinder chamber 22 to form a suction chamber 22*a*. Meanwhile, in a chamber on the left signal of the blade 28, a discharge hole 23*a* shown in FIG. 1 opens to an inner surface of the cylinder chamber 22 to form a discharge chamber 22*b*.

On both side faces of the blade 28, semicircular bushes 25, 25 are provided tight to seal those surfaces. Between the blade 28 and the bushes 25, 25, lubrication is provided by the lubricating oil 9.

With regard to operation of the compression section 2, as the crankpin 26 eccentrically rotates along with the drive shaft 12, the roller 27 fitted to the crankpin 26 revolves while an outer circumferential surface of the roller 27 is kept in contact with the inner circumferential surface of the cylinder chamber 22.

As the roller 27 revolves within the cylinder chamber 22, the blade 28 advances and retreats with both side faces of the blade 28 held by the bushes 25, 25. Then, the low-pressure refrigerant is sucked from the suction pipe 11 into the suction chamber 22*a*. After the refrigerant is compressed to a high pressure in the discharge chamber 22*b*, the high-pressure refrigerant is discharged through the discharge hole 23*a*.

Figure 3:
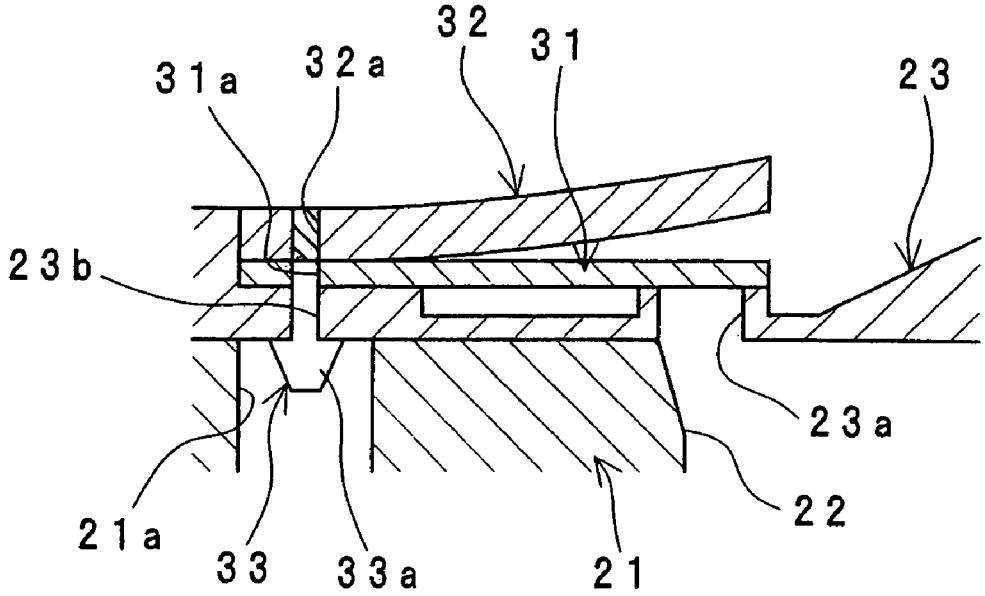
FIG. 3 is a main-part enlarged sectional view showing the first embodiment of the compressor of the invention.

As shown in FIGS. 1 and 3, the upper end-face member 23 (hereinafter, referred to as end-face member 23) has the discharge hole 23*a* communicating with the cylinder chamber 22, and a through hole 23*b* provided outside and near the discharge hole 23*a*.

A platy discharge valve 31 and a platy valve holding member 32 are provided at the end-face member 23. The discharge valve 31 opens and closes the discharge hole 23*a*, while the valve holding member 32 sandwiches and holds the discharge valve 31 in cooperation with the end-face member 23. The discharge valve 31 has a hole portion 31*a*, and the valve holding member 32 has a screw hole 32*a*.

The discharge valve 31 and the valve holding member 32 are fixed to the end-face member 23 by a fixing bolt 33. That is, a head portion 33*a* of the fixing bolt 33 is placed on one side of the end-face member 23 facing the cylinder body 21, the fixing bolt 33 is inserted into the through hole 23*b* of the end-face member 23 as well as into the hole portion 31*a* of the discharge valve 31, and is screwed with the screw hole 32*a* of the valve holding member 32, in which state the discharge valve 31 is sandwiched and held by the end-face member 23 and the valve holding member 32.

The discharge valve 31 in a free state closes the discharge hole 23*a*. When the refrigerant (compressed gas) within the cylinder chamber 22 has reached to a specified pressure, the compressed gas, elastically deforming the discharge valve 31, is discharged through the discharge hole 23*a*. It is noted that the valve holding member 32 suppresses motion of the discharge valve 31 so as to prevent the discharge valve 31 from being deformed (swinging) more than necessary.

At the end-face member 23, a cup-shaped muffler body 40 is mounted so as to cover the discharge valve 31. This muffler body 40 is fixed to the end-face member 23 by a fixing member (such as a bolt).

The muffler body 40 and the end-face member 23 define a muffler chamber 41. The muffler chamber 41 and the cylinder chamber 22 are communicated with each other via the discharge hole 23*a*.

The muffler body 40 has a hole portion 40*a*. The hole portion 40*a* makes the muffler chamber 41 communicated with outside of the muffler body 40.

According to the compressor of this construction, the fixing bolt 33 is inserted into the through hole 23*b* of the end-face member 23 and screwed with the screw hole 32*a* of the valve holding member 32, in which state the discharge valve 31 is sandwiched and held between the end-face member 23 and the valve holding member 32. Therefore, without the need for threading the through hole 23*b* of the end-face member 23, thickness around the through hole 23*b* of the end-face member 23 can be reduced. That is, the axial (thicknesswise) size of the discharge hole 23*a* of the end-face member 23 is made smaller.

Thus, the capacity (hereinafter, referred to as top clearance) of the discharge hole 23*a* of the end-face member 23 is made smaller, so that the compressed gas remaining within the discharge hole 23*a* at an end of compression is made smaller in quantity.

Accordingly, degradation of the operating efficiency as well as increase of the operating noise caused by re-expansion of the compressed gas derived from within the discharge hole 23*a* can be prevented. More specifically, the capacity efficiency can be enhanced with a low-speed operation of the compressor, while the motive power can be decreased with a high-speed operation of the compressor. Besides, a pulsating pressure caused by the re-expansion of the compressed gas can be decreased, so that the operating noise can be decreased.

Further, the fixing bolt 33 and the screw hole 32*a* of the valve holding member 32 are coupled to each other by a screw. Therefore, in comparison with the case where the valve holding member 32 and the end-face member 23 are fixed by a rivet, it becomes possible to retighten the fixing bolt 33, as well as to correct alignment between the discharge valve 31 and the discharge hole 23*a*, thus facilitating, for example, the fitting of seal.

Further, in comparison with the case where the valve holding member 32 and the end-face member 23 are fixed by screw and nut, the parts count is decreased so that the assembly working efficiency is improved.

The cylinder body 21 has, at an end face thereof, a recessed portion 21*a* for housing therein the head portion 33*a* of the fixing bolt 33. Thus, the head portion 33*a* of the fixing bolt 33 can be hidden in the recessed portion 21*a* of the end face of the cylinder body 21. Accordingly, since the fixing bolt 33 can be placed so as to avoid the cylinder chamber 22, the through hole 23*b* of the end-face member 23, into which the fixing bolt 33 is to be inserted, does not serve as a bypass passage for the cylinder chamber 22, thus keeping from any degradation of compression performance.

The end-face member 23 is formed of a casting or sintered material. Thus, the end-face member 23 can be manufactured with low cost. That is, even if the end-face member 23 is made smaller in thickness at a portion thereof where the discharge valve 31 is fixed, the end-face member 23 is burdened by only a compressive stress. This allows the end-face member 23 to be formed of a casting or sintered material, which is a fragile material.

Second Embodiment

Figure 4:
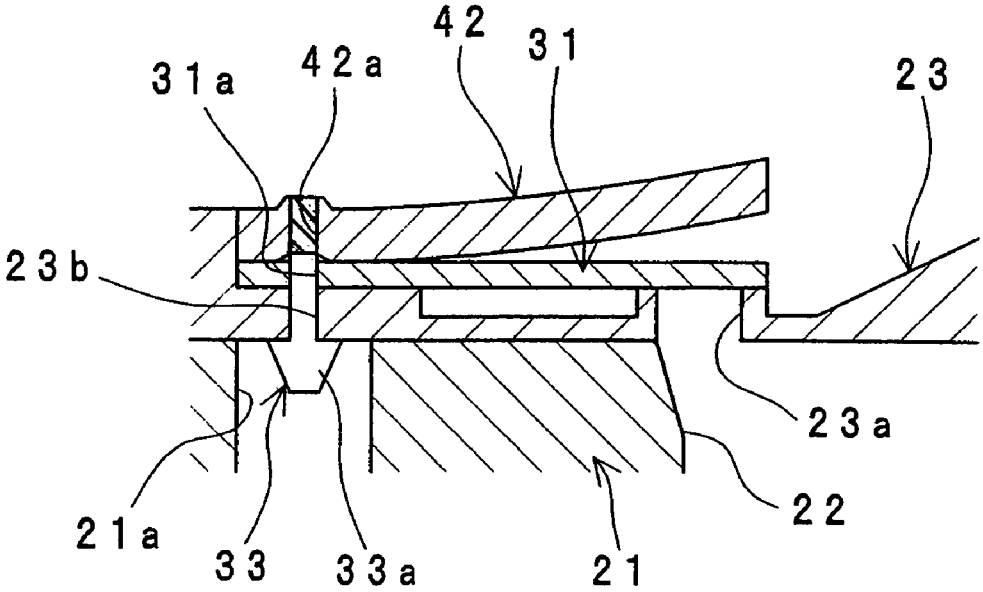
FIG. 4 is a main-part enlarged sectional view showing a second embodiment of the compressor of the invention.

FIG. 4 shows a second embodiment of the invention. In this second embodiment, a screw hole 42*a* of a valve holding member 42 is finished by burring process. The valve holding member 42 is made of a punched material of expandable steel. It is noted that component members designated by like reference numerals in conjunction with the first embodiment are identical in construction to those of the first embodiment, and so their description is omitted.

Thus, since the screw hole 42*a* of the valve holding member 42 is finished by burring process, an effective thread length can be ensured without increasing the thickness of the valve holding member 42. Also, a periphery of the screw hole 42*a* on one side on which the fixing bolt 33 is to be inserted through can be automatically chamfered so as to be rounded, providing a guide for insertion of the fixing bolt 33 to facilitate the assembly.

Since the valve holding member 42 is formed of a punched material of steel, the number of stage changing steps for the burring process of the screw hole 42*a* can be reduced. Thus, the valve holding member 42 can be manufactured with low cost.

Third Embodiment

Figure 5:
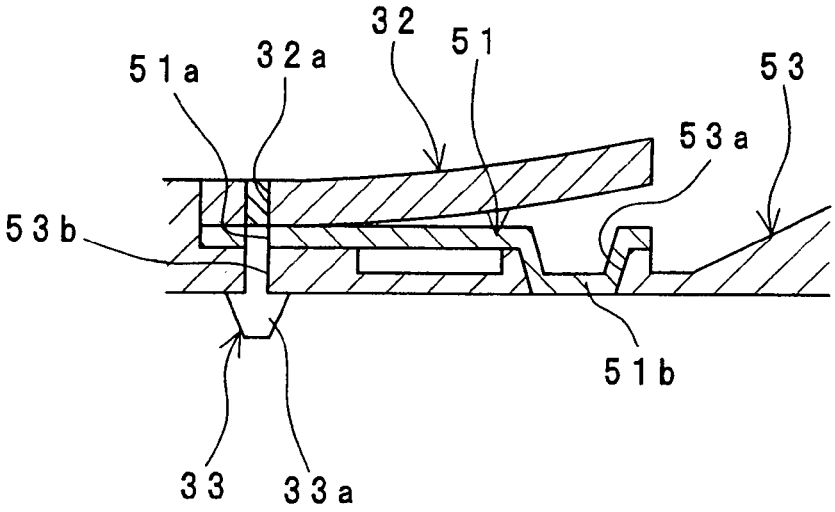
FIG. 5 is a main-part enlarged sectional view showing a third embodiment of the compressor of the invention.

FIG. 5 shows a third embodiment of the invention. In this third embodiment, an end-face member 53 has a discharge hole 53*a* through which compressed gas is discharged, and a through hole 53*b* into which the fixing bolt 33 is to be inserted through. A discharge valve 51 has a hole portion 51*a* through which the fixing bolt 33 is to be inserted, and a projecting portion 51*b* which projects into the discharge hole 53*a* of the end-face member 53. It is noted that component members designated by like reference numerals in conjunction with the first embodiment are identical in construction to those of the first embodiment, and so their description is omitted.

More specifically, the projecting portion 51*b* of the discharge valve 51 is formed into such a tapered configuration that the projecting portion 51*b* becomes thinner at its tip. The discharge hole 53*a* of the end-face member 53 is formed into a tapered configuration corresponding to the configuration of the projecting portion 51*b*.

Thus, since the discharge valve 51 has a projecting portion 51*b* that enters into the discharge hole 53*a* of the end-face member 53, the capacity of the discharge hole 53*a* of the end-face member 53 can be made further smaller by the entry of the projecting portion 51*b* of the discharge valve 51 into the discharge hole 53*a* of the end-face member 53, so that the compressed gas remaining within the discharge hole 53*a* at an end of compression can be made further smaller in quantity. Accordingly, degradation of the operating efficiency as well as increase of the operating noise can be further suppressed.

By the entry of the projecting portion 51*b* of the discharge valve 51 into the discharge hole 53*a* of the end-face member 53, sealability of the discharge valve 51 for the discharge hole 53*a* can be ensured. Also, when the discharge valve 51 is assembled to the end-face member 53, performing the positioning with the projecting portion 51*b* entered into the discharge hole 53*a* facilitates the assembling of the discharge valve 51 to the end-face member 53.

Also, since the projecting portion 51*b* and the discharge hole 53*a* are formed into tapered configurations, the projecting portion 51*b* can be fitted into the discharge hole 53*a* in a generally coincident state, so that sealability of the discharge valve 51 for the discharge hole 53*a* can be further improved.

Still also, since the axial size of the discharge hole 53*a* is a small one, the projecting portion 51*b* can be set to a small height size. Thus, since the projecting portion 51*b* can be set small in height size, degradation of parts precision in the projecting portion 51*b* can be prevented.

Fourth Embodiment

Figure 6:
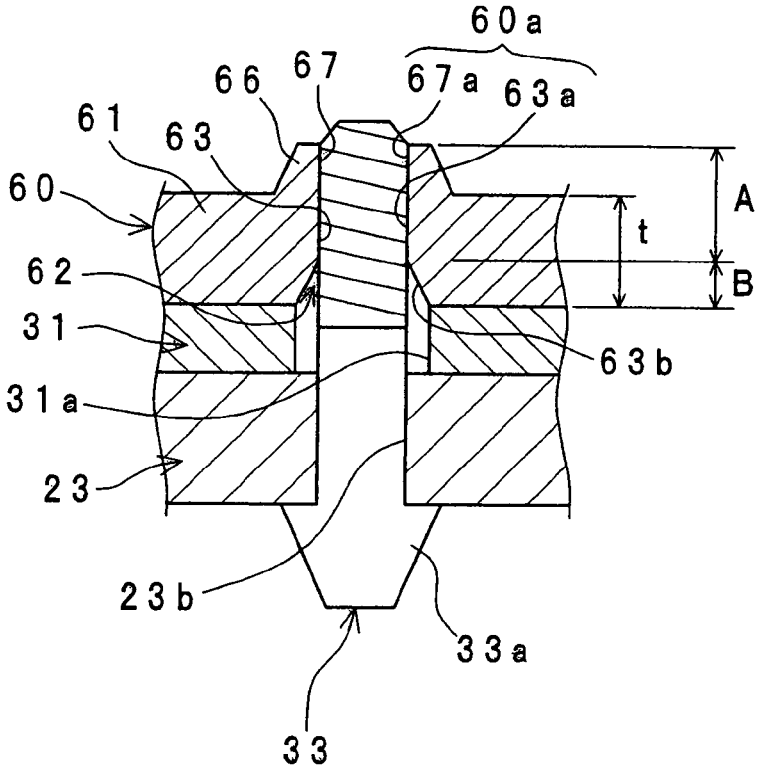
FIG. 6 is a main-part enlarged sectional view showing a fourth embodiment of the compressor of the invention.

FIG. 6 shows a fourth embodiment of the invention. In this fourth embodiment, a valve holding member 60 has a platy body portion 61, and an annular protruding portion 66 provided on one surface of the body portion 61 opposite to a surface on which the discharge valve 31 is provided. It is noted that component members designated by like reference numerals in conjunction with the first embodiment shown in FIG. 3 are identical in construction to those of the first embodiment, and so their description is omitted.

The body portion 61 has a hole portion 62. An inner circumferential surface 63 of the hole portion 62 of the body portion 61 is formed into a cylindrical surface 63*a* and a tapered surface 63*b* in an order from the one surface to the other surface of the body portion 61. The cylindrical surface 63*a* extends thicknesswise of the body portion 61. The tapered surface 63*b* stretches so as to be wider increasingly on the other surface side of the body portion 61. That is, the tapered surface 63*b* forms a chamfered surface.

The annular protruding portion 66 is provided so as to surround the hole portion 62 of the body portion 61. An inner circumferential surface 67 of the annular protruding portion 66 is formed into a cylindrical surface 67*a*. The cylindrical surface 67*a* is equal in diameter to the cylindrical surface 63*a* of the body portion 61, and concentrically adjoins the cylindrical surface 63*a* of the body portion 61.

The cylindrical surface 63*a* of the body portion 61 and the cylindrical surface 67*a* of the annular protruding portion 66 form a screw hole 60*a* in cooperation. The cylindrical surface 67*a* of the annular protruding portion 66 allows the screw hole 60*a* to be elongated in thread length. That is, the screw hole 60*a* has a thread length A equal to or more than a thickness t of the body portion 61.

The tapered surface 63*b* and the annular protruding portion 66 are formed, for example, by a punching press. That is, the tapered surface 63*b* of the body portion 61, the cylindrical surface 63*a* of the body portion 61, and the cylindrical surface 67*a* of the annular protruding portion 66 are formed in a punching order.

According to the compressor of this construction, since the inner circumferential surface 63 of the hole portion 62 in the body portion 61 of the valve holding member 60 is formed into the cylindrical surface 63*a* and the tapered surface 63*b*, the fixing bolt 33, when inserted into the hole portion 62 of the valve holding member 60, is aligned by the tapered surface 63*b* of the hole portion 62, so that the fixing bolt 33 can be led to the screw hole 60*a* with reliability.

Also, the portion of the body portion 61 where the tapered surface 63*b* is formed comes to have elasticity, so that the screw hole 60*a* becomes reducible or expandable in diameter. That is, the tapered surface 63*b* of the body portion 61 serves as a flexural margin B of the elasticity. Accordingly, when the fixing bolt 33 is screwed with the screw hole 60*a*, any initial loosening of the fixing bolt 33 due to the screw hole 60*a* can be prevented.

Further, since the screw hole 60*a* has the thread length A equal to or more than the thickness t of the body portion 61, the thread length A of the screw hole 60*a* can be ensured even with the thickness t of the body portion 61 decreased, so that the fixing bolt 33 can be tightened to the screw hole 60*a* with reliability.

Thus, since the fixing bolt 33 becomes less liable to loosening, the fixing bolt 33 is prevented from falling into the cylinder body 21 even if the head portion 33*a* of the fixing bolt 33 is located on the cylinder body 21 side (shown in FIG. 3). As a consequence, there is no need for disassembling the assembled end-face member 23 and cylinder body 21 to take out the fixing bolt 33 that has fallen within the cylinder body 21, hence high reliability and good durability.

Fifth Embodiment

Figure 7:
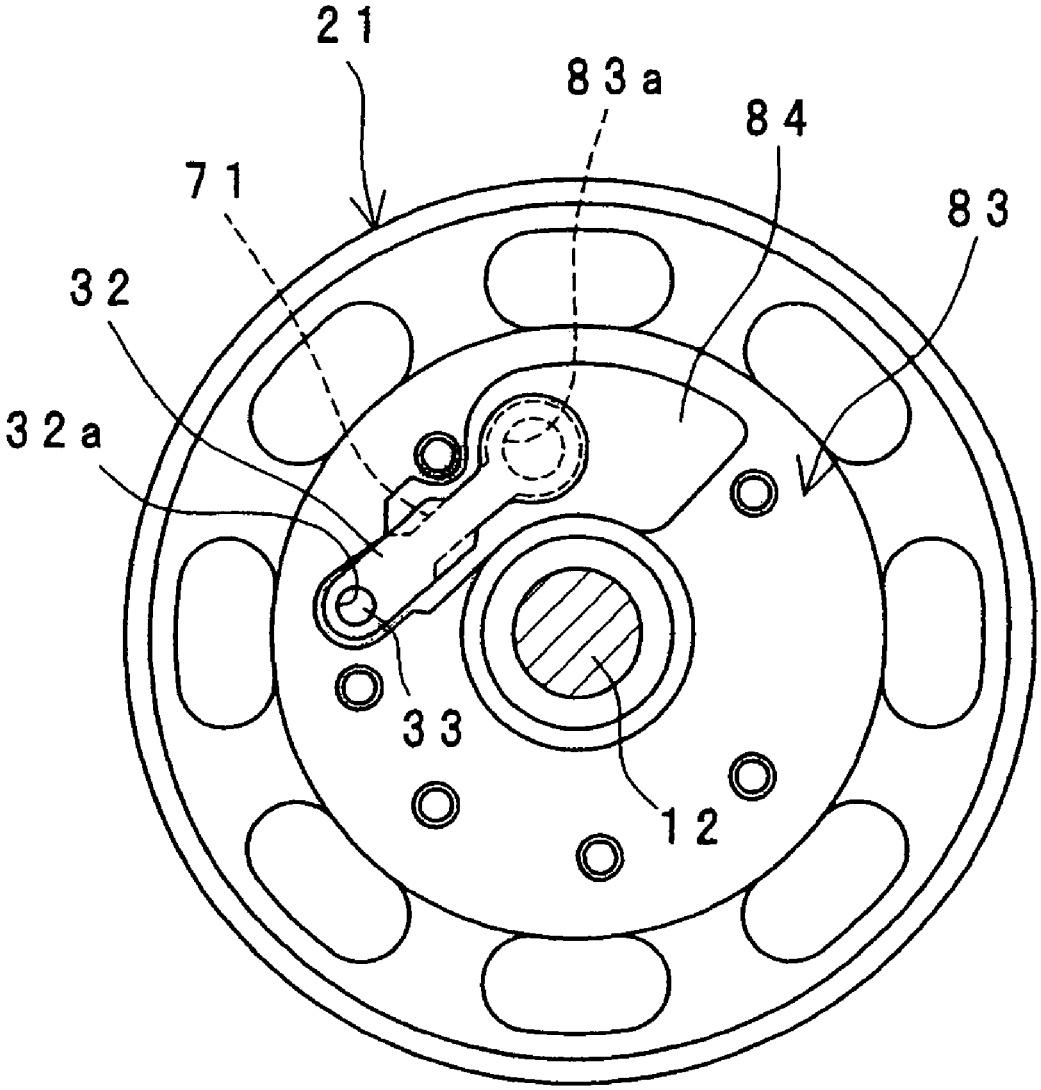
FIG. 7 is a plan view showing a fifth embodiment of the compressor of the invention.
Figure 8:
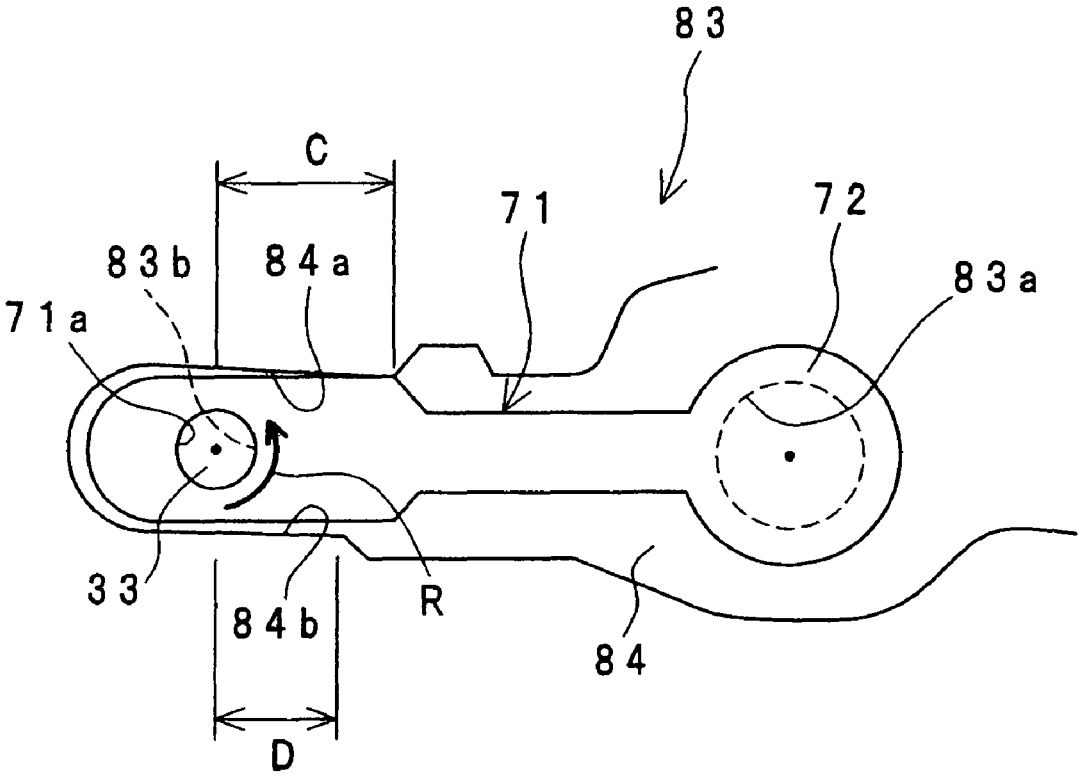
FIG. 8 is a main-part enlarged sectional view of FIG. 7.

FIGS. 7 and 8 show a fifth embodiment of the invention. In this fifth embodiment, a depressed portion 84 for housing therein a discharge valve 71 and the valve holding member 32 is provided in an end face of an end-face member 83. It is noted that component members designated by like reference numerals in conjunction with the first embodiment shown in FIG. 3 are identical in construction to those of the first embodiment, and so their description is omitted.

The depressed portion 84 has one side face 84*a* and the other side face 84*b* generally oppositely confronting each other. For general positioning of respective sites of the discharge valve 71 and the valve holding member 32 around the fixing bolt 33, the one side face 84*a* and the other side face 84*b* are located on both sides of those sites, respectively.

The one side face 84*a* and the other side face 84*b* extend from a through hole 83*b* toward a discharge hole 83*a*. The discharge hole 83*a* and the through hole 83*b* are provided in the end-face member 83, as is the case also with the discharge hole 23*a* and the through hole 23*b* in the end-face member 23 shown in FIG. 3.

The one side face 84*a* is placed on one side on which when the fixing bolt 33 is rotated in a direction in which the fixing bolt 33 is tightened to the screw hole 32*a* of the valve holding member 32 from the cylinder body 21 side of the end-face member 83, the valve holding member 32 integrally rotates along with the fixing bolt 33 so that a portion of the valve holding member 32 on one side closer to the discharge hole 83*a* than the axis of the fixing bolt 33 makes contact with the one side face 84*a*. In FIG. 8, the direction in which the fixing bolt 33 is tightened is indicated by an arrow R.

The other side face 84*b* is placed on one side on which when the fixing bolt 33 is rotated in a direction in which the fixing bolt 33 is tightened to the screw hole 32*a* of the valve holding member 32 from the cylinder body 21 side of the end-face member 83, the valve holding member 32 integrally rotates along with the fixing bolt 33 so that a portion of the valve holding member 32 on one side closer to the discharge hole 83*a* than the axis of the fixing bolt 33 goes away from the other side face 84*b*.

A length C of the one side face 84*a* from the through hole 83*b* toward the discharge hole 83*a* is longer than a length D of the other side face 84*b* from the through hole 83*b* toward the discharge hole 83*a*. In more detail, a comparison is made about a length component that connects a center of the discharge hole 83*a* and a center of the through hole 83*b* to each other as viewed along an axial direction of the fixing bolt 33.

Side faces of respective sites of the discharge valve 71 and the valve holding member 32 around the fixing bolt 33 are generally parallel to the line connecting the through hole 83*b* and the discharge hole 83*a* to each other. The one side face 84*a* and the other side face 84*b* are smooth surfaces and are slightly inclined with respect to the line connecting the through hole 83*b* and the discharge hole 83*a* to each other.

The discharge valve 71 has a mounting hole 71*a* and a cover portion which goes into or out of contact with the discharge hole 83*a*. When the fixing bolt 33 is rotated in the direction of being tightened from the cylinder body 21 side of the end-face member 83, the discharge valve 71 integrally rotates along with the valve holding member 32 due to friction with the valve holding member 32.

Then, when the portion of the discharge valve 71 closer to the discharge hole 83*a* than the axis of the fixing bolt 33 comes into contact with the one side face 84*a* of the depressed portion 84, the center of the cover portion 72 of the discharge valve 71 and the center of the discharge hole 83*a* become generally coincident with each other.

According to the compressor of this construction, since the length C of the one side face 84*a* from the through hole 83*b* toward the discharge hole 83*a* is longer than the length D of the other side face 84*b* from the through hole 83*b* toward the discharge hole 83*a*, the discharge valve 71 and the valve holding member 32, in the tightening of the fixing bolt 33 to the screw hole 32*a*, are securely blocked by the one side face 84*a* of the depressed portion 84 even if those are integrally rotated along with the rotation of the fixing bolt 33.

Also, since the other side face 84*b* is shorter than the one side face 84*a*, a space of the depressed portion 84 on the other side face 84*b* side can be made larger so that reduction of the discharge space can be prevented. That is, since the muffler body 40 is mounted on the end-face member 83 as shown in FIG. 1, the possibility that the space of the depressed portion 84 can be enlarged makes it possible to enlarge the space of the muffler chamber 41. It is noted that in FIG. 7, the muffler body 40 is omitted in illustration.

Further, the other side face 84*b* together with the one side face 84*a* can easily lead the discharge valve 71 and the valve holding member 32 toward the through hole 83*b*.

Accordingly, rotational position accuracy of the discharge valve 71 and the valve holding member 32 in their assembly can be improved by the one side face 84*a* side of the depressed portion 84, while increase in discharge pressure loss can be avoided by the other side face 84*b* side of the depressed portion 84.

Also, when the discharge valve 71 comes into contact with the one side face 84*a* of the depressed portion 84, the center of the cover portion 72 of the discharge valve 71 and the center of the discharge hole 83*a* become generally coincident with each other. Therefore, in the tightening of the fixing bolt 33 to the screw hole 32*a*, the discharge valve 71 integrally rotates along with the valve holding member 32 by following the rotation of the fixing bolt 33, thus making contact with the one side face 84*a* of the depressed portion 84. Accordingly, tightening the fixing bolt 33 allows the center of the cover portion 72 of the discharge valve 71 and the center of the discharge hole 83*a* to automatically become generally coincident with each other, so that the positional accuracy of the discharge valve 71 and the discharge hole 83*a* can be further improved.

In short, the one side face 84*a* has a function of positioning the discharge valve 31. The one side face 84*a* and the other side face 84*b* have a function of guiding the discharge valve 71 and the valve holding member 32.

In addition, the one side face 84*a* may be other than a smooth surface and have a protruding portion, while the discharge valve 71 may be so set that upon its contact with the protruding portion of the one side face 84*a*, the center of the cover portion 72 of the discharge valve 71 and the center of the discharge hole 83*a* become generally coincident with each other. The length C of the one side face 84*a* may also be one which is not longer than the length D of the other side face 84*b*, where the discharge valve 71 and the valve holding member 32, in the tightening of the fixing bolt 33, are blocked by the one side face 84*a* of the depressed portion 84 even if those are integrally rotated by following the rotation of the fixing bolt 33.

Sixth Embodiment

Figure 9:
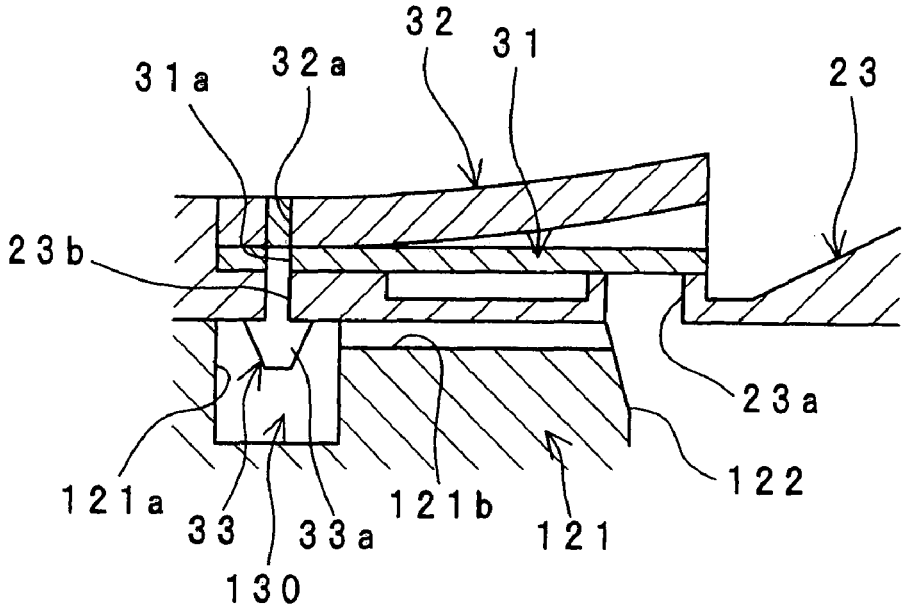
FIG. 9 is a main-part enlarged sectional view showing a sixth embodiment of the compressor of the invention.
Figure 10:
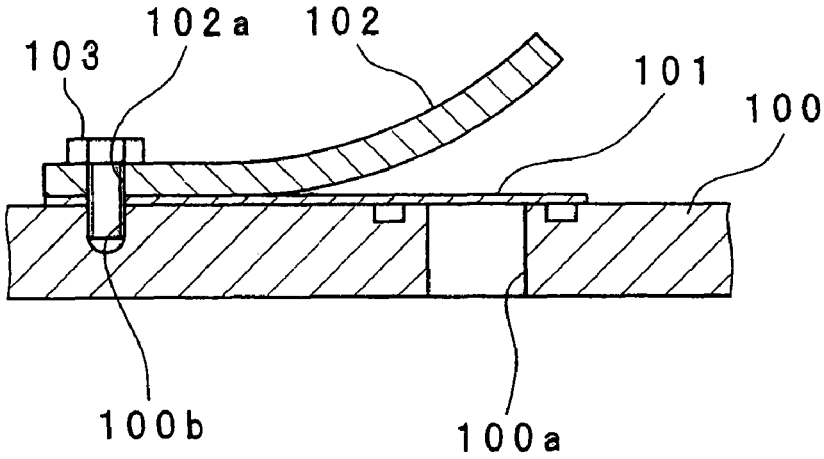
Fig.10 PRIOR ART
FIG. 10 is a main-part enlarged sectional view of a compressor according to a prior art.

FIG. 9 shows a sixth embodiment of the invention. In this sixth embodiment, a recessed portion 121*a* for housing therein the head portion 33*a* of the fixing bolt 33 is provided at an end face of a cylinder body 121, where the recessed portion 121*a* forms a Helmholtz type resonance chamber 130. It is noted that component members designated by like reference numerals in conjunction with the first embodiment shown in FIG. 3 are identical in construction to those of the first embodiment, and so their description is omitted.

The resonance chamber 130 is a space defined by the recessed portion 121*a* and the end-face member 23. In the cylinder body 121, a connecting passage 121*b* for connecting the resonance chamber 130 and a cylinder chamber 122 to each other is provided.

The connecting passage 121*b* is a groove provided in an end face of the cylinder body 121. The connecting passage 121*b* opens near the discharge hole 23*a*. The connecting passage 121*b* may also be formed as a hole extending through the cylinder body 121.

According to the compressor of this construction, since the recessed portion 121*a* forms the Helmholtz type resonance chamber 130, waves of pulsating noise of the refrigerant gas that occurs upon compression in the cylinder chamber 122 interfere with waves derived from the resonance chamber 130 so as to damp to a large extent. Therefore, pulsating noise decreases, so that a reduction of noise can be achieved. Thus, the recessed portion 121*a* can be used both as a space for housing the bolt head portion 33*a* therein and as a resonance chamber.

The present invention is not limited to the foregoing embodiments. For example, although the foregoing embodiments have been described on a swing compressor in which the roller 27 and the blade 28 are integrated together, yet the invention may be applied to a compressor in which the roller and the blade are provided separate from each other. The compressor may also be a reciprocating compressor. It is also possible that the discharge valve 31 has no hole portion 31*a* through which the fixing bolt 33 is to be inserted, and the discharge valve 31 may be sandwiched and held by the end-face member 23 and the valve holding member 32. Further, the discharge valve 31, 51, 71, the valve holding member 32, 42, 60 and the fixing bolt 33 may also be mounted on the lower end-face member 24. The recessed portion 21*a*, which is not limited to a space having a bottom face, may also be a hole extending through the cylinder body 21.

What is claimed is:

1. A compressor comprising:

a cylinder body which forms a cylinder chamber;

an end-face member which is mounted on an end face of the cylinder body and which has a discharge hole communicating with the cylinder chamber and a through hole;

a discharge valve for opening and closing the discharge hole of the end-face member;

a valve holding member which sandwiches the discharge valve in cooperation with the end-face member and which has a screw hole formed in a body portion of the valve holding member; and a fixing bolt having a head portion, the head portion of the fixing bolt being placed on one side of the end-face member on which the cylinder body is provided, and the fixing bolt being inserted into the through hole of the end-face member so as to be screwed with the screw hole of the valve holding member, in which state the discharge valve is sandwiched by the end-face member and the valve holding member, the end-face member having an end face with a depressed portion disposed therein to house the discharge valve and the valve holding member, with the depressed portion and the body portion of the valve holding member being shaped to limit rotation of the body portion relative to the end face member when the valve holding member is disposed in the depressed portion prior to mounting the fixing bolt, the depressed portion having one side face and an other side face which are generally opposed to each other, the one side face and the other side face being located on both sides of respective sites around the fixing bolt in the discharge valve and the valve holding member so as to allow a positioning of the respective sites, respectively, the discharge valve and the valve holding member being disposed between the one side face and the other side face with clearance therebetween, when the fixing bolt is rotated in a direction in which the fixing bolt is tightened to the screw hole of the valve holding member from the cylinder body side of the end-face member and the valve holding member integrally rotates along with the fixing bolt, a part of the body portion of the valve holding member between the discharge hole and an axis of the fixing bolt makes contact with the one side face while the part of the body portion of the valve holding member between the discharge hole and the axis of the fixing bolt moves away from the other side face, a length of the one side face from the through hole toward the discharge hole being longer than a length of the other side face from the through hole toward the discharge hole, the discharge valve having a cover portion which goes into or out of contact with the discharge hole, and when the fixing bolt is rotated in the direction of being tightened from the cylinder body side of the end-face member, the discharge valve integrally rotates along with the valve holding member, and a portion of the discharge valve between the discharge hole and the axis of the fixing bolt comes into contact with the one side face of the depressed portion so that a center of the cover portion of the discharge valve and a center of the discharge hole become aligned with each other when the one side face of the depressed portion is contacted by the portion of the discharge valve between the discharge hole and the axis of the fixing bolt and when the other side face of the depressed portion is not contacted by the portion of the discharge valve between the discharge hole and the axis of the fixing bolt.

2. The compressor as claimed in claim 1, wherein the cylinder body has, in an end face of the cylinder body, a recessed portion for housing therein the head portion of the fixing bolt.

3. The compressor as claimed in claim 1, wherein the screw hole of the valve holding member is finished by burring process.

4. The compressor as claimed in claim 3, wherein the valve holding member is formed of a punched material of steel.

5. The compressor as claimed in claim 1, wherein the end-face member is formed of a casting or sintered material.

6. The compressor as claimed in claim 1, wherein the discharge valve has a projecting portion which enters into the discharge hole of the end-face member.

7. The compressor as claimed in claim 6, wherein the projecting portion of the discharge valve is formed into such a tapered configuration that the projecting portion becomes thinner at its tip, and the discharge hole of the end-face member is formed into a tapered configuration corresponding to the configuration of the projecting portion.

8. The compressor as claimed in claim 1, wherein the body portion has a hole portion, and the valve holding member has an annular protruding portion provided around the hole portion on one surface of the body portion opposite to a surface on which the discharge valve is provided, wherein an inner circumferential surface of the hole portion of the body portion is formed into a cylindrical surface and a tapered surface in an order from the one surface side toward the other side of the body portion, an inner circumferential surface of the annular protruding portion is formed into a cylindrical surface which is equal in diameter to the cylindrical surface of the body portion and which concentrically adjoins the cylindrical surface of the body portion, and the cylindrical surface of the body portion and the cylindrical surface of the annular protruding portion cooperatively form the screw hole.

9. The compressor as claimed in claim 8, wherein the screw hole has a thread length equal to or more than a thickness of the body portion.

10. The compressor as claimed in claim 2, wherein the recessed portion forms a Helmholtz type resonance chamber, and a connecting passage for connecting the resonance chamber and the cylinder chamber to each other is provided in the cylinder body.

11. A compressor comprising:

a cylinder body which forms a cylinder chamber;

an end-face member which is mounted on an end face of the cylinder body and which has a discharge hole communicating with the cylinder chamber and a through hole;

a discharge valve for opening and closing the discharge hole of the end-face member;

a valve holding member which sandwiches the discharge valve in cooperation with the end-face member and which has a screw hole formed in a body portion of the valve holding member; and a fixing bolt having a head portion, the head portion of the fixing bolt being placed on one side of the end-face member on which the cylinder body is provided, and the fixing bolt being inserted into the through hole of the end-face member so as to be screwed with the screw hole of the valve holding member, in which state the discharge valve is sandwiched by the end-face member and the valve holding member, wherein the discharge valve has a wide portion fixed by the fixing bolt, a cover portion to open and close the discharge hole and a narrow portion positioned between the wide portion and the cover portion, the wide portion is wider than the narrow portion in width, a diameter of the cover portion is larger than a width of the narrow portion, the end-face member having an end face with a depressed portion disposed therein to house the discharge valve and the valve holding member, with the depressed portion and the body portion of the valve holding member being shaped to limit rotation of the body portion relative to the end face member when the valve holding member is disposed in the depressed portion prior to mounting the fixing bolt, and the narrow portion defining space between side faces of the narrow portion and side faces of the depressed portion so that the narrow portion does not come into contact with the side faces of the depressed portion so that elastic deformation of the narrow portion is not suppressed by the side faces of the depressed portion when the wide portion is fixed to the end-face member by the fixing bolt, so that the wide portion comes into contact with one of the side faces of the depressed portion, and so that a center of the cover portion of the discharge valve and a center of the discharge hole become aligned with each other when a first of the side faces of the depressed portion is contacted by the wide portion of the discharge and when a second of the side faces of the depressed portion is not contacted by the wide portion of the discharge valve.

12. The compressor as claimed in claim 11, wherein the center of the cover portion is arranged to be offset from the center of the discharge hole if the second side face of the depressed portion is contacted by the wide portion of the discharge valve.

13. The compressor as claimed in claim 11, wherein a space is formed between the second side face of the depressed portion and the discharge valve when the first side face of the depressed portion is contacted by the wide portion of the discharge valve, the space being disposed along an entirety of the wide portion of the discharge valve.

14. The compressor as claimed in claim 1, wherein the center of the cover portion is arranged to be offset from the center of the discharge hole if the other side face of the depressed portion is contacted by the portion of the discharge valve between the discharge hole and the axis of the fixing bolt.

15. The compressor as claimed in claim 1, wherein a space is formed between the other side face of the depressed portion and the discharge valve when the one side face of the depressed portion is contacted by the portion of the discharge valve between the discharge hole and the axis of the fixing bolt, the space being disposed along an entirety of the portion of the discharge valve between the discharge hole and the axis of the fixing bolt.

* * * * *